US005445378A

United States Patent [19]

Cook

[11] Patent Number: 5,445,378

[45] Date of Patent: Aug. 29, 1995

[54] PLAYING CARD HOLDER

[76] Inventor: Frances M. Cook, 8301 Morgan Dr., Sarasota, Fla. 34238

[21] Appl. No.: 364,735

[22] Filed: Dec. 27, 1994

[51] Int. Cl.[6] ..... A63F 1/10

[52] U.S. Cl. ..... 273/150

[58] Field of Search ..... 273/150

[56] References Cited

U.S. PATENT DOCUMENTS 1,109,524 9/1914 Gessner ..... 273/150

FOREIGN PATENT DOCUMENTS 670675 8/1929 France ..... 273/150

55456 4/1911 Switzerland ..... 273/150

107597 7/1918 United Kingdom ..... 273/150

*Primary Examiner*—Benjamin H. Layno

[57] ABSTRACT

A playing card holder having a handle, the handle having a head extension and the head extension mounting a support plate, and the support plate including a pocket, and the pocket arranged to accommodate a first row of cards, and the pocket having a pocket front wall arranged to engage a second row of cards, with a first spring wire loop arranged to engage in a biased relationship the support plate front wall, and a second spring wire loop arranged to engage the pocket front wall, with the first spring wire loop and the second spring wire loop secured to the head.

7 Claims, 4 Drawing Sheets

PLAYING CARD HOLDER

TECHNICAL FIELD

The field of invention relates to playing card holder structure, and more particularly pertains to a playing card holder arranged for ease of manipulation to readily support plural rows in a spaced tier fashion of playing cards to accommodate such games as canasta and the like, as well as supporting various visual aid cards in a plural tier manner.

BACKGROUND OF THE INVENTION

The prior art has heretofore provided for playing card holders, as exemplified by the U.S. Pat. Nos. 4,927,149; 5,029,797; 4,625,966; and 4,073,494.

The instant invention attempts to improve over such prior art structures by directing the manual manipulation of plural rows of playing cards in a spaced relationship relative to one another for ease of viewing and support.

SUMMARY OF THE INVENTION

The playing card holder of the invention includes a tapered handle structure that employs an optionally utilized base, wherein the handle has a head extension, and the head extension supports fixedly a support plate, with the support plate having a front wall, the front wall having a pocket, the pocket supporting a first row of playing cards, and the pocket front wall supporting a second row of playing cards, such that first and second wire loops arranged to engage the front wall and the pocket front wall secure the plural rows of playing cards in a secure orientation relative to one another and to the apparatus.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
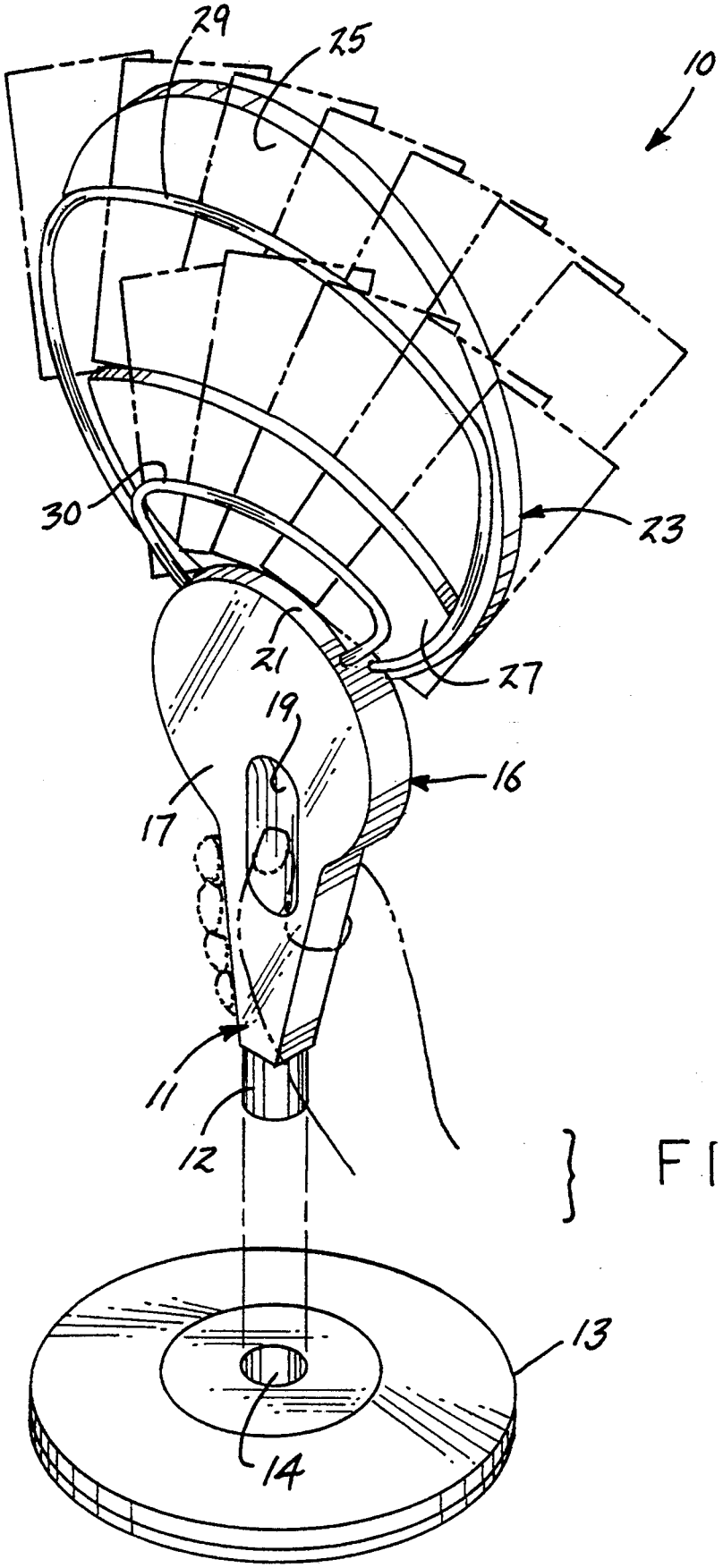
FIG. 1 is an isometric illustration of the invention.
Figure 2:
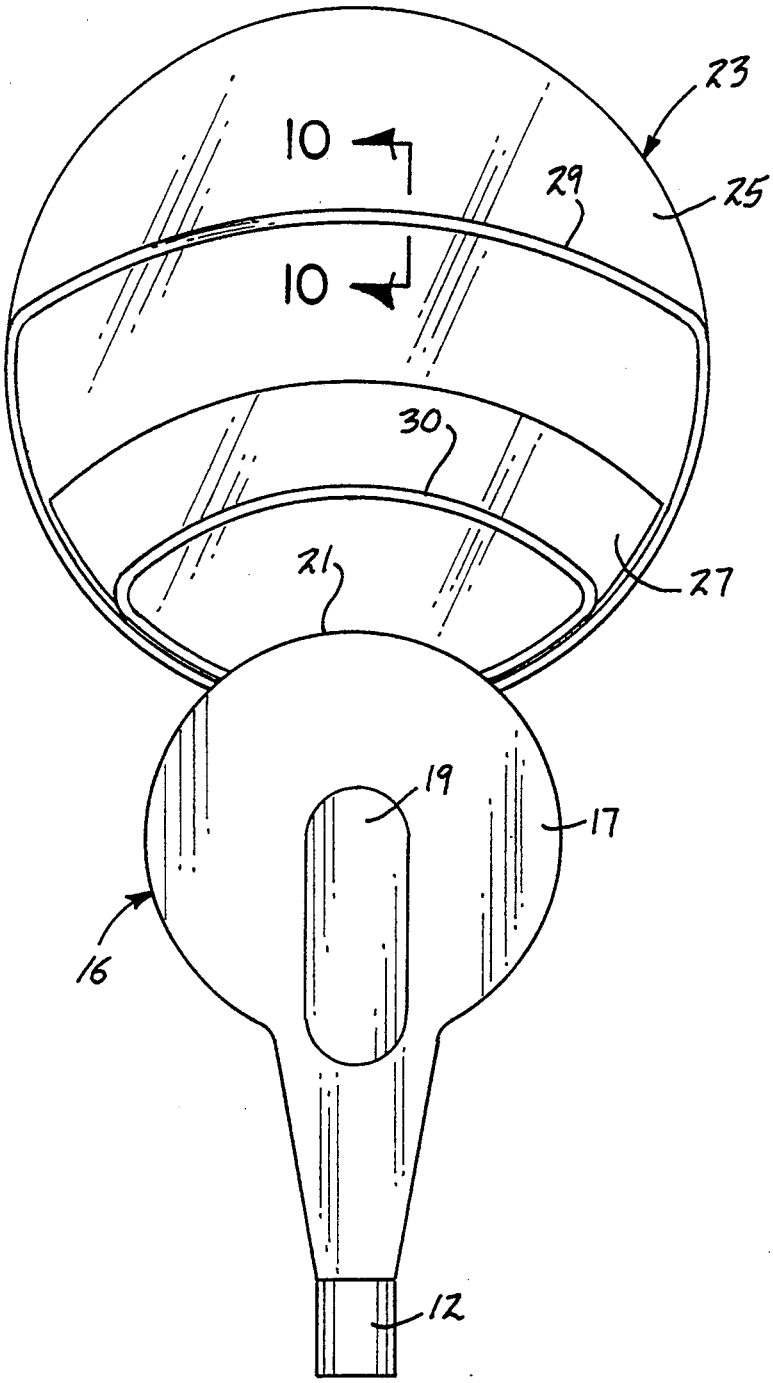
FIG. 2 is an orthographic view, taken in elevation, of the invention.
Figure 3:
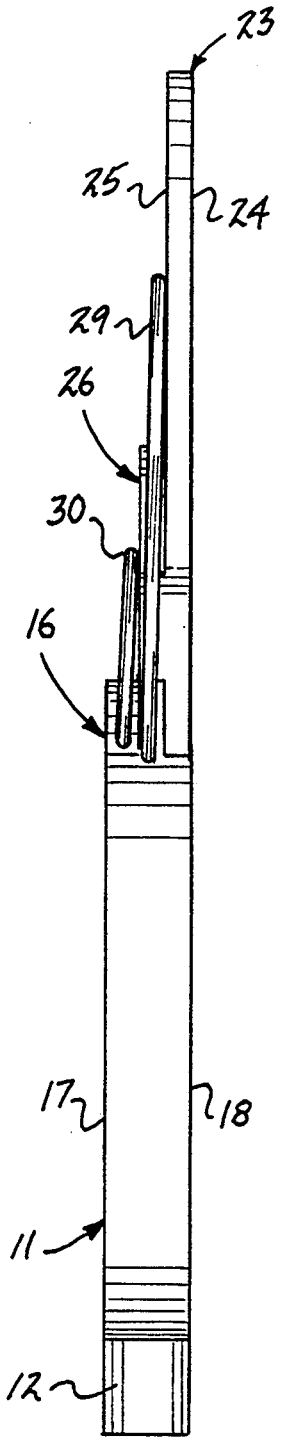
FIG. 3 is a side view, taken in elevation, of the invention.
Figure 6:
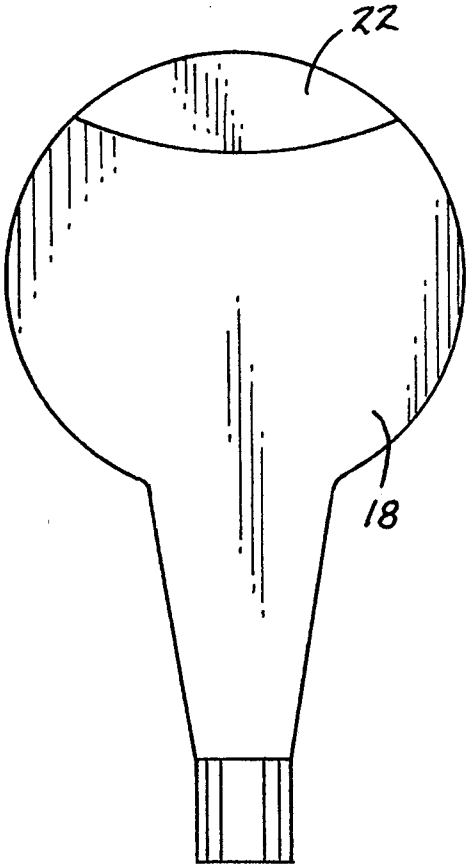
FIG. 6 is a rear view, taken in elevation, of the handle structure.
Figure 5:
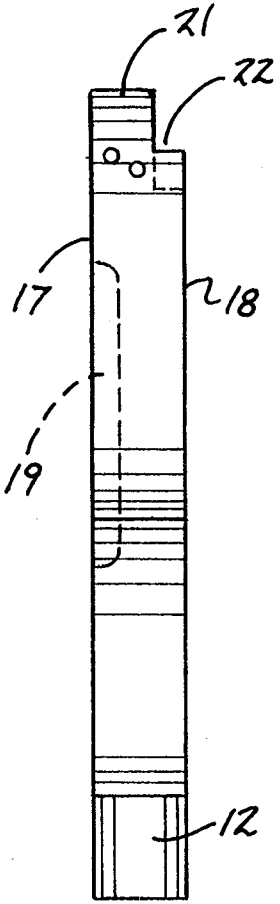
FIG. 5 is a side view, taken in elevation, of the handle structure.
Figure 4:
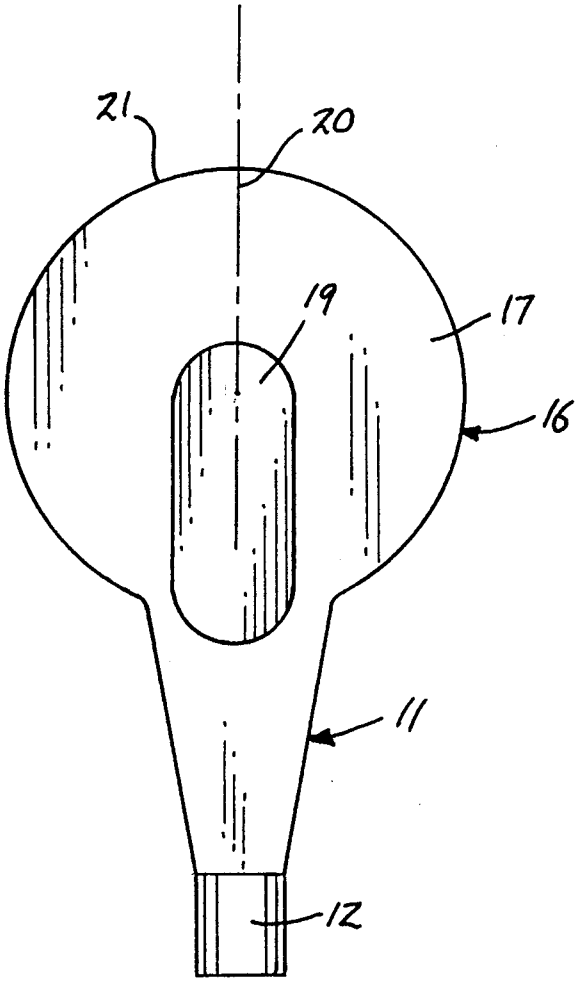
FIG. 4 is a frontal view, taken in elevation, of the handle structure.
Figure 9:
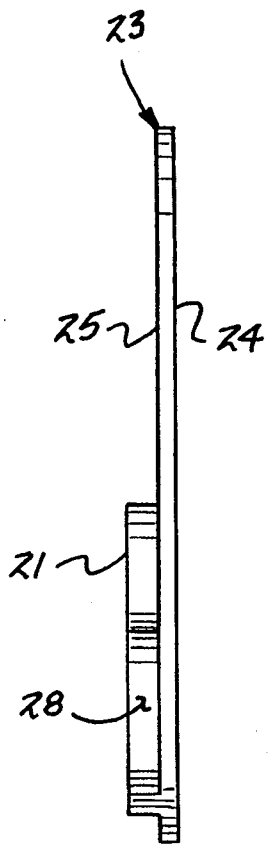
FIG. 9 is a side view of the support plate with the pocket member indicated in cross-section to indicate the pocket cavity therewithin.
Figure 10:
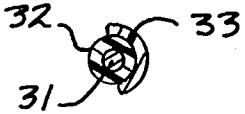
FIG. 10 is a cross-sectional view, taken along the lines 10—10 of FIG. 2, indicating the wire loop cross-sectional construction.
Figure 7:
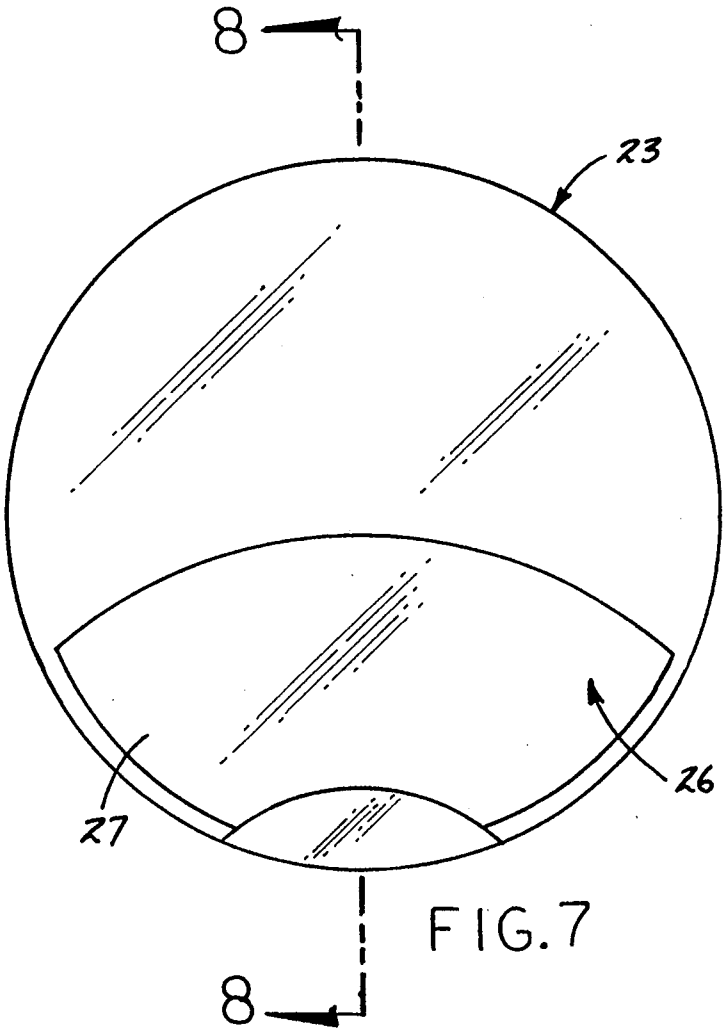
FIG. 7 is a front view, taken in elevation, of the support plate.
Figure 8:
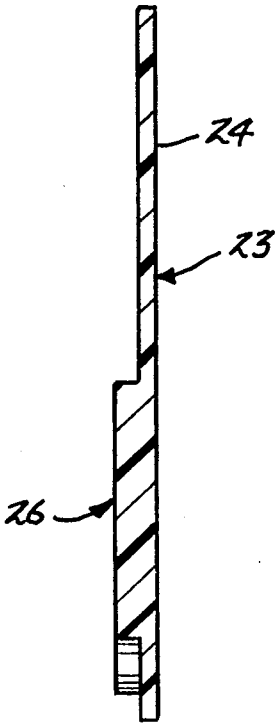
FIG. 8 is a cross-sectional illustration, taken along the lines 8—8 of FIG. 7.

The playing card holder 10 of the invention comprises a handle 11 having tapering side walls converging downwardly to a base projection 12. The base projection 12 is arranged for reception within a support base 13, and more specifically within a bore 14 directed into a top wall of that support base 13. A semi-circular head 16 extends fixedly from the handle 11, with the head 16 integral with the handle, such that the handle and the head define a handle front wall 17 spaced from a handle rear wall 18. A thumb receiving trough 19 is recessed below the handle front wall 17 and the trough 19 extends partially into the handle and the head of the handle front wall 17 in a generally parallel relationship relative to a handle axis 20 directed medially and symmetrically of the handle 11. The head 16 includes a head top wall 21 medially intersected by the axis 20, with a stepped recess 22 directed into the head top wall 21 extending to the handle rear wall 18, such as indicated in the FIG. 5 for example. To this end, a card support plate 23 is secured to the stepped recess 22 and is arranged and oriented symmetrically to each side of the axis 20, with the support plate 23 indicated of a generally circular configuration but not necessarily limited thereto, with the plate having a plate rear wall 24 spaced from a plate front wall 25. The plate rear wall 24 is indicated coplanar with the handle rear wall 18 to permit the holder structure when removed from the base 13 to be readily supported upon an underlying support surface, such as a table top and the like. The support plate front wall 25 is spaced from the handle front wall 17, with a pocket 26 integral with the handle front wall and extending from the head top wall 21 spaced from an upper periphery of the support plate 23, such that the pocket defines a pocket front wall 27 and a pocket cavity 28. The pocket cavity 28 is arranged to accommodate a first row or tier of playing cards, such as indicated in FIG. 1, with the pocket front wall 27 arranged to engage a second row or tier of playing cards. To secure the playing cards, a first spring wire loop 29 is secured to the head top wall 21 and extends coextensively over the support plate front wall 25, with a second spring wire loop 30 spaced from the first spring wire loop 29, with the second spring wire loop extending over the pocket front wall 27 arranged to engage the pocket front wall 27. It should be noted that the first and second spring wire loops 29 and 30 are arranged for bias and contiguous communication with the respective support plate front wall 25 and the pocket front wall 27. Each of the wire loops 29 and 30 include a wire central core 31 (see FIG. 10), with a polymeric covering 32 extending over and surrounding the wire central core 31 to prevent damage to card members and also arranged for ease of manual manipulation via frictional covering for ease of engagement. Optionally, a polymeric foam layer 33 is arranged over each of the wire loops of each of the respective first and second spring wire loops 29 and 30 to engage the respective support plate front wall 25 and the pocket front wall 27 to secure cards. The second tier of cards engaging the pocket front wall 27 rests upon the head top wall 21, as illustrated in FIG. 1 for example.

The first and second spring wire loops are arranged in a concentric relationship relative to one another whose center of revolution is directed through the head 16 adjacent to the head top wall 21, with the spring wire loops positioned substantially medially of the respective support plate front wall 25 and pocket front wall 27 of the respective first and second spring wire loops 29 and 30.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A playing card holder comprising, a rigid handle, the handle having a front wall spaced from a rear wall, and a handle lowermost end, and the handle extending into a support head spaced from the lowermost end, and the support head having a head front wall coplanar with the handle front wall, and the support head having a head rear wall coplanar with the handle rear wall, and the head having a head top wall spaced from the handle lowermost end, and the head top wall having fixedly secured thereto a support plate, the support plate having a support plate rear wall spaced from a support plate front wall, and the support plate front wall is spaced from the handle front wall, and an axis symmetrically directed through the handle and the support head, and the axis spaced from the support plate front wall, and a pocket member secured fixedly to the support plate front wall, the pocket having a pocket front wall spaced from the support plate front wall and spaced from the handle front wall, and a first spring means arranged to engage the support plate front wall, with the first spring means secured to the support head top wall, and a second spring means secured to the support head top wall arranged for bias engagement of the pocket front wall, and wherein the first spring means defines a first spring wire support member, and the second spring means defines a second spring wire support member.

2. A playing card holder as set forth in claim 1 wherein the support plate rear wall and the handle rear wall are coplanar to permit ease of positioning upon an underlying support.

3. A playing card holder as set forth in claim 2 wherein the first spring wire support member and the second spring wire support member are arranged in a concentric relationship relative to one another.

4. A playing card holder as set forth in claim 3 wherein the pocket defines a pocket cavity between the pocket front wall and the support plate front wall.

5. A playing card holder as set forth in claim 4 wherein at least said first spring wire support member defines a central wire core having a polymeric covering and a polymeric foam layer in facing relationship to the support plate front wall.

6. A playing card holder as set forth in claim 5 including a thumb receiving trough recessed below the handle front wall and the support head front wall and arranged parallel to the axis and extending partially into the handle and the support head.

7. A playing card holder as set forth in claim 6 including a base member, the base member including a base top wall, and the base top wall having a bore arranged to receive a handle lowermost end.

* * * * *